US012037028B2

(12) United States Patent
Anderson et al.

(10) Patent No.: US 12,037,028 B2
(45) **Date of Patent: *Jul. 16, 2024**

(54) LOCKING ASSEMBLY

(71) Applicant: Transportation IP Holdings, LLC, Norwalk, CT (US)

(72) Inventors: John D. Anderson, Oswego, IL (US); Walter J. Peach, Montgomery, IL (US); Edward L. Vechiola, Lombard, IL (US)

(73) Assignee: TRANSPORTATION IP HOLDINGS, LLC, Norwalk, CT (US)

( * ) Notice: Subject to any disclaimer, the term of this patent is extended or adjusted under 35 U.S.C. 154(b) by 267 days.

This patent is subject to a terminal disclaimer.

(21) Appl. No.: 17/364,354

(22) Filed: Jun. 30, 2021

(65) Prior Publication Data

US 2021/0323584 A1 Oct. 21, 2021

Related U.S. Application Data

(63) Continuation of application No. 16/567,947, filed on Sep. 11, 2019, now Pat. No. 11,077,869, which is a continuation-in-part of application No. 15/462,119, filed on Mar. 17, 2017, now Pat. No. 10,442,446.

(60) Provisional application No. 62/339,354, filed on May 20, 2016.

(51) Int. Cl.
*B61D 3/18* (2006.01)

(52) U.S. Cl.
CPC ..... *B61D 3/187* (2013.01)

(58) Field of Classification Search
CPC ... B61D 3/00; B61D 3/02; B61D 3/04; B61D 3/16; B61D 3/18; B61D 3/187
See application file for complete search history.

(56) References Cited

U.S. PATENT DOCUMENTS

| | | | |
|---|---|---|---|
| 5,515,792 | A | 5/1996 | Bullock et al. |
| 5,535,681 | A | 7/1996 | Sarnicki et al. |
| 5,575,222 | A | 11/1996 | Sauer et al. |
| 5,596,936 | A | 1/1997 | Bullock et al. |
| 5,845,584 | A | 12/1998 | Bullock et al. |

(Continued)

OTHER PUBLICATIONS

1 Office Action dated Jan. 24, 2023 for corresponding Canadian Patent Application No. 2,967,148 (3 pages).

(Continued)

*Primary Examiner* — Robert J McCarry, Jr.
(74) *Attorney, Agent, or Firm* — The Small Patent Law Group LLC; Christopher R. Carroll

(57) ABSTRACT

A locking assembly includes an elongated guide tube configured to be coupled to a first component. The guide tube is elongated in a first direction from a first end to an opposite second end. The locking assembly also includes a first pin partially disposed in the guide tube and protruding from the first end of the guide tube. The first pin can be received in a first receiver. The locking assembly also includes a second pin partially disposed in the guide tube and protruding from the second end of the guide tube. This second pin can be received in a second receiver. The locking assembly also includes a handle removably coupled with the second pin. The handle can be grasped and moved to slide the second pin relative to the guide tube and the first pin along the first direction.

18 Claims, 15 Drawing Sheets

(56) References Cited

U.S. PATENT DOCUMENTS

| | | | | |
|---|---|---|---|---|
| 11,077,869 | B2 * | 8/2021 | Anderson | B61D 3/187 |
| 2009/0304481 | A1 * | 12/2009 | Larsen | B61D 3/187<br>414/340 |

OTHER PUBLICATIONS

Picture of Portec Holland hinge b, date unknown but may be prior to priority date of this application.

* cited by examiner

LOCKING ASSEMBLY

CROSS-REFERENCE TO RELATED APPLICATIONS

This application is a continuation of U.S. patent application Ser. No. 16/567,947, filed 11 Sep. 2019, which is a continuation-in-part of U.S. patent application Ser. No. 15/462,119, filed 17 Mar. 2017 (now U.S. Pat. No. 10,442,446), which claims priority to U.S. Provisional Application No. 62/339,354, filed 20 May 2016. The entire disclosures of these applications are incorporated herein by reference.

BACKGROUND

Technical Field

The subject matter described herein relates to assemblies for affixing one component to another component.

Discussion of Art

Locking assemblies can be used to couple components to each other. In high load and/or high usage environments, these assemblies can break or otherwise fail. As one example, the railroad industry uses auto-rack railroad cars for transporting other vehicles. These auto-rack cars use bridge plates in gaps between the cars to provide a continuous surface over which vehicles can be moved into the auto-rack cars that are used to load and unload a string or series of connected or coupled auto-rack cars.

The bridge plates can be pivotally attached to the auto-rack cars by locking assemblies. These locking assemblies can include multiple outwardly extending pins (including a spring biased locking pin) that pivotally attach the bridge plates to the auto-rack cars. The locking assemblies are connected to and can be accessed from the bottom sides of the bridge plates.

During use, installation, and/or removal of bridge plates that have such locking assemblies, the bridge plates and the locking assemblies thereof are often subjected to various forces (such as forces that occur when such bridge plates are dropped). When a bridge plate is subjected to such forces, one or more components of the locking assembly of that bridge plate can be bent, cracked, or otherwise damaged. For example, in the known locking assembly described above, one or more of: (i) the guide tube; (ii) the first slidable locking pin; (iii) the second slidable locking pin; and (v) the pivot pin, often become bent or otherwise damaged. When this occurs, the locking assembly does not easily function, does not properly function, or does not function at all. In another example, the collar journaled about the second slidable locking pin can crack and then move with respect to the second slidable locking pin. When this occurs, the tension provided by the spring on the first and second locking pins is reduced and this know locking assembly does not easily function, does not properly function, or does not function at all.

This known locking assembly cannot be easily, quickly, or efficiently repaired because the first locking pin, the second locking pin, and the respective handles are welded to each other and thus cannot be readily removed from the guide tube. Thus, the entire locking assembly may need to be replaced or the entire bridge plate may need to be replaced.

BRIEF DESCRIPTION

In one embodiment, a locking assembly is provided that includes an elongated guide tube configured to be coupled to a first component. The guide tube is elongated in a first direction from a first end to an opposite second end. The locking assembly also includes a first pin partially disposed in the guide tube and protruding from the first end of the guide tube. The first pin can be received in a first receiver. The locking assembly also includes a second pin partially disposed in the guide tube and protruding from the second end of the guide tube. This second pin can be received in a second receiver. The locking assembly also includes a handle removably coupled with the second pin. The handle can be grasped and moved to slide the second pin relative to the guide tube and the first pin along the first direction.

Another locking assembly includes a guide channel configured to be coupled to a first component and extending from a first open end to a second open end, a pivot pin partially disposed in the guide channel at the first open end, a locking pin partially disposed in the guide channel at the second open end, and a handle removably coupled with the locking pin. The handle is configured to be moved relative to the guide channel to slide the locking pin out of or into the guide channel.

Another example of a locking assembly includes a guide tube configured to be coupled to a first component. The guide tube extends in a first direction from a first open end to a second open end. The locking assembly also includes a first pin protruding from the first open end of the guide tube. The first pin is configured to be received in a second component. The locking assembly includes a second pin protruding from the second open end of the guide tube. The second pin is configured to move relative to the guide tube and the first pin to be received in the second component. The locking assembly also includes a handle removably coupled with the second pin. The handle is configured to be grasped and moved to slide the second pin relative to the guide tube and the first pin.

BRIEF DESCRIPTION OF THE DRAWINGS

The inventive subject matter may be understood from reading the following description of non-limiting embodiments, with reference to the attached drawings, wherein below.

DETAILED DESCRIPTION

Figure 1:
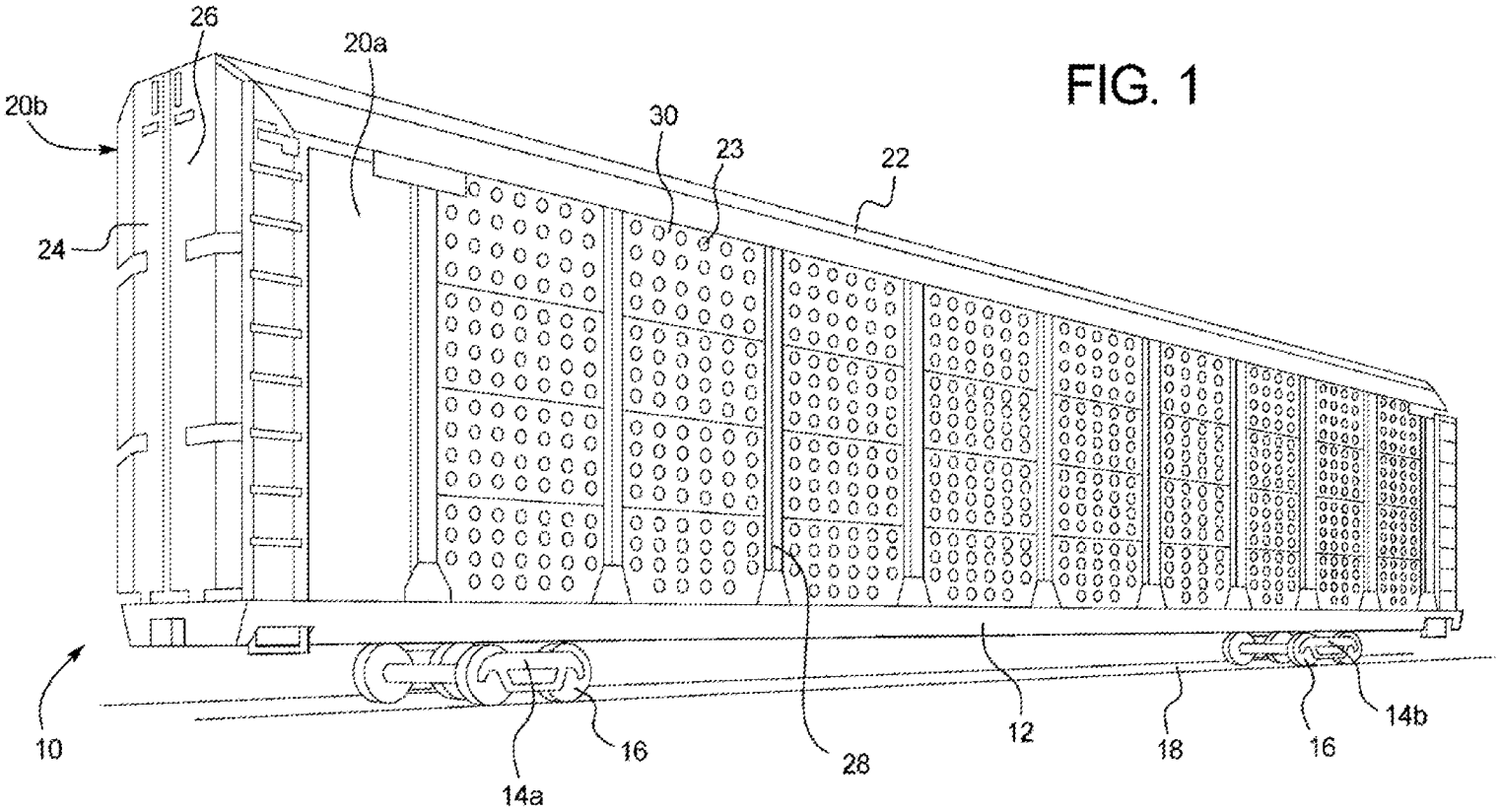
FIG. 1 is a side perspective view of a vehicle.

FIG. 1 illustrates one example of a vehicle 10 with which the locking assembly can be used. The vehicle shown in FIG. 1 is an auto-rack railroad car, but optionally can be another type of vehicle or may be other non-vehicular equipment. The vehicle frame 12 supported by trucks 14*a* and 14*b*. Each truck has wheels 16 that roll along tracks 18 during movement. The frame 12 supports opposing sidewalls 20*a* and 20*b* and a roof 22. The vehicle includes a pair of co-acting clamshell doors 24 and 26 mounted on each end of the vehicle 10. The doors 24 and 26 are opened to facilitate the loading and unloading of other, smaller vehicles (e.g., automobiles) into and out of the vehicle 10 and are closed during transport or storage of the other, smaller vehicles.

The sidewalls 20 include vertical posts 28 mounted on and upwardly extending from the frame 12. The roof 22 is mounted on and supported by these posts. The posts are spaced along the length of the sidewalls 20 of the vehicle 10. Side wall panels 30 horizontally extend and are vertically spaced apart. These side wall panels are mounted between the vertical posts 28. The side wall panels can be supported at corners of the panels by brackets that are secured to the posts. The side wall panels may have several sidewall panel holes 23.

FIGS. 2A, 2B, 3A, 3B, 4, 5, 6, 7, 8, 9, 10, 11, and 12 illustrate one example of a locking assembly 100. The locking assembly 100 may be a bridge plate locking assembly that locks bridge plates within the vehicle 10 during loading, unloading, or moving of the smaller vehicles onto, off of, or within the vehicle 10. Alternatively, the locking assembly 100 can be used to couple two components together other than a bridge plate and a rail car. For example, the locking assembly 100 can be used to couple a door to a frame, a lid to a container, or the like.

Figure 2A:
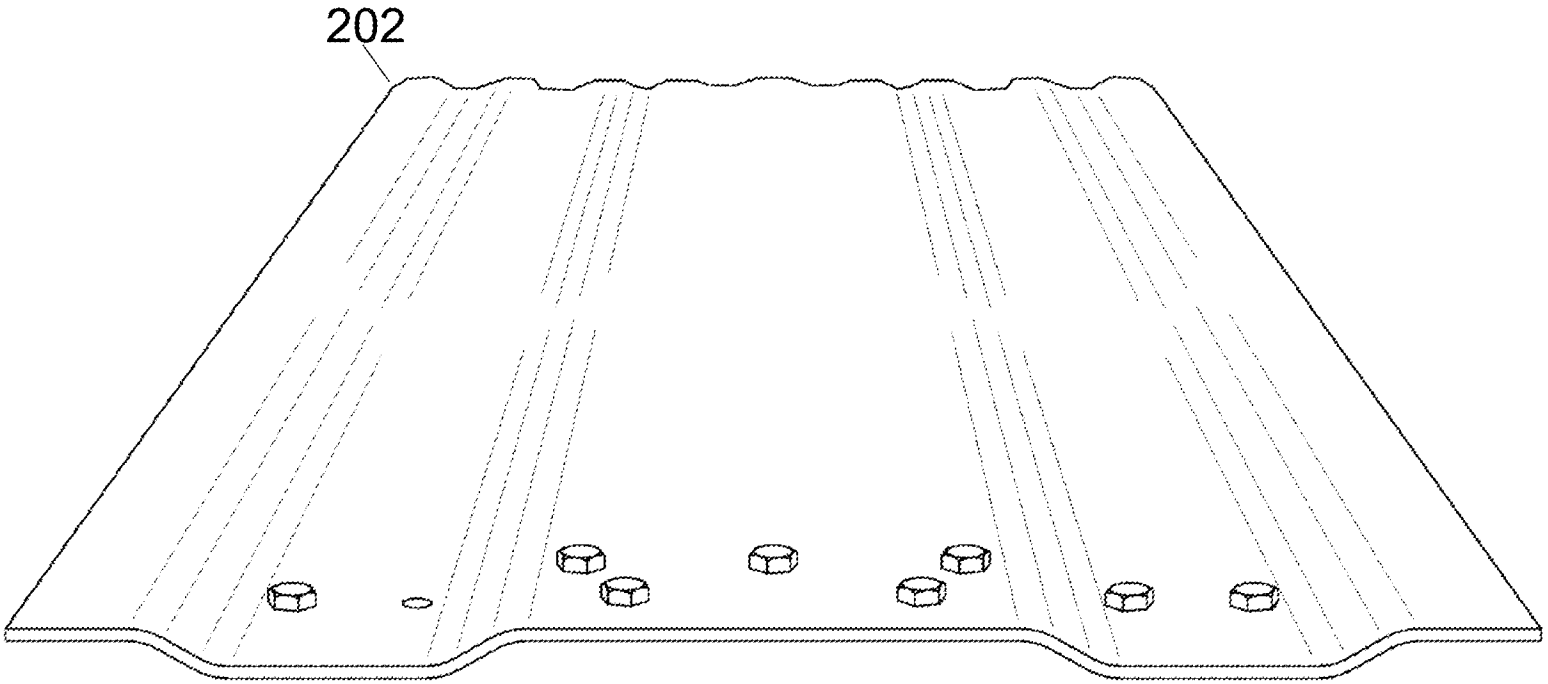
FIG. 2A is a top perspective view of a plate with one example of a locking assembly attached to the plate.
Figure 2B:
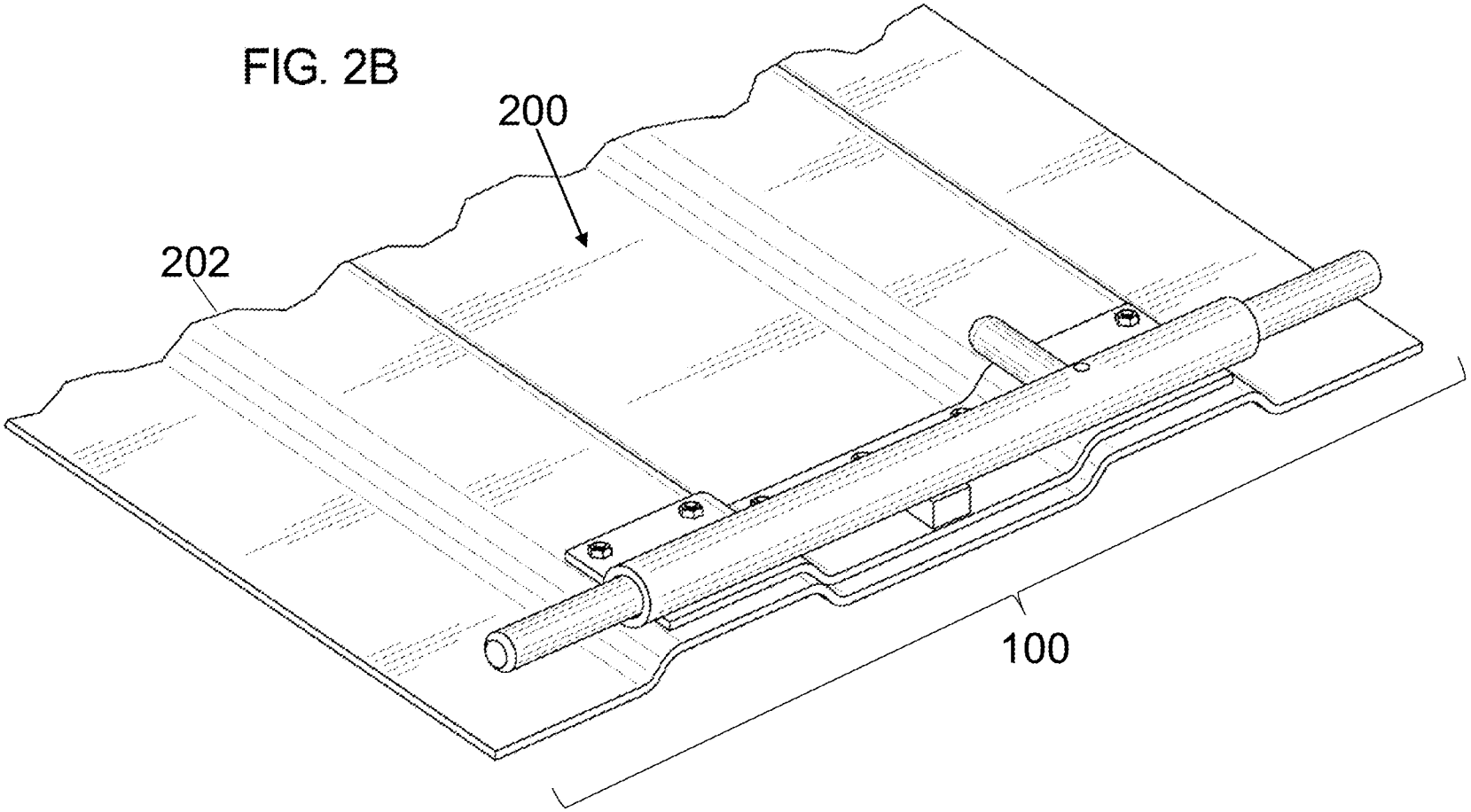
FIG. 2B is a bottom perspective view of the plate shown in FIG. 2A with the locking assembly also shown in FIG. 2A attached to the plate.

FIGS. 2A and 2B illustrate the locking assembly 100 attached to one surface or side 200 of a bridge plate 202. The bridge plate 202 can be an auto-rack railroad car bridge plate in one embodiment. Optionally, the bridge plate 202 can represent another component, such as a door, a door frame, or the like (whether onboard a vehicle or off-board a vehicle).

Figure 3A:
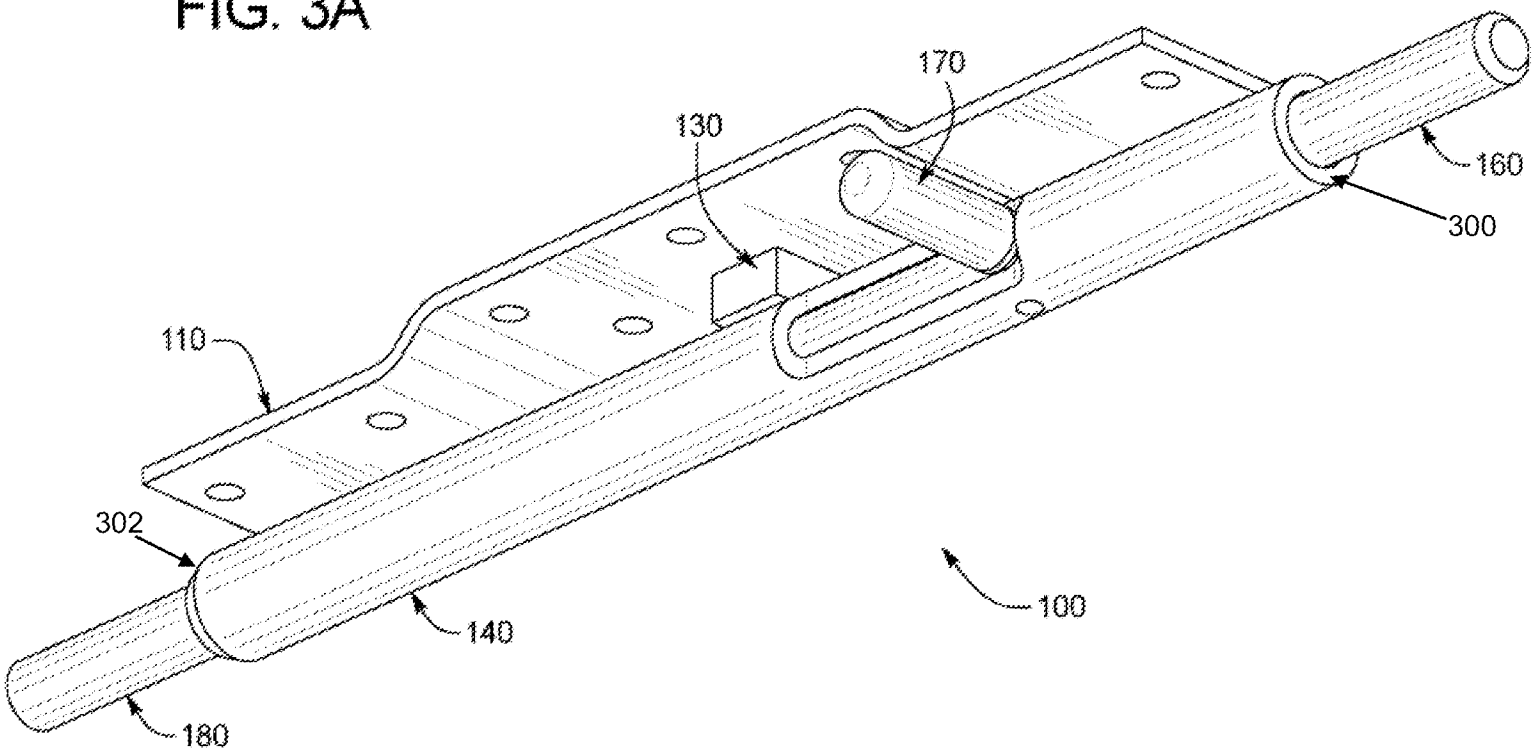
FIG. 3A is a bottom front perspective view of the locking assembly shown in FIGS. 2A and 2B.
Figure 3B:
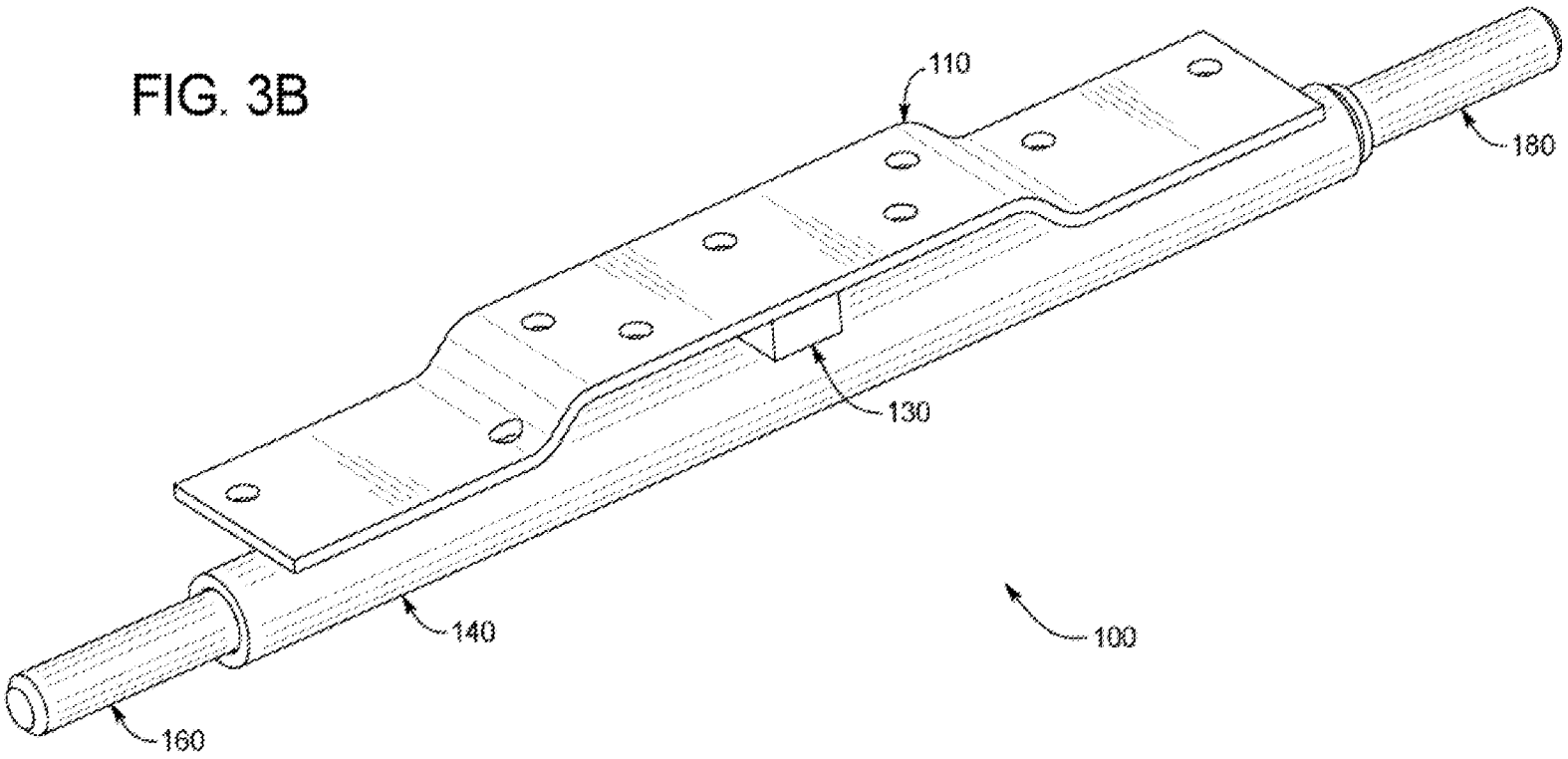
FIG. 3B is a rear top perspective view of the locking assembly shown in FIG. 3A.
Figure 4:
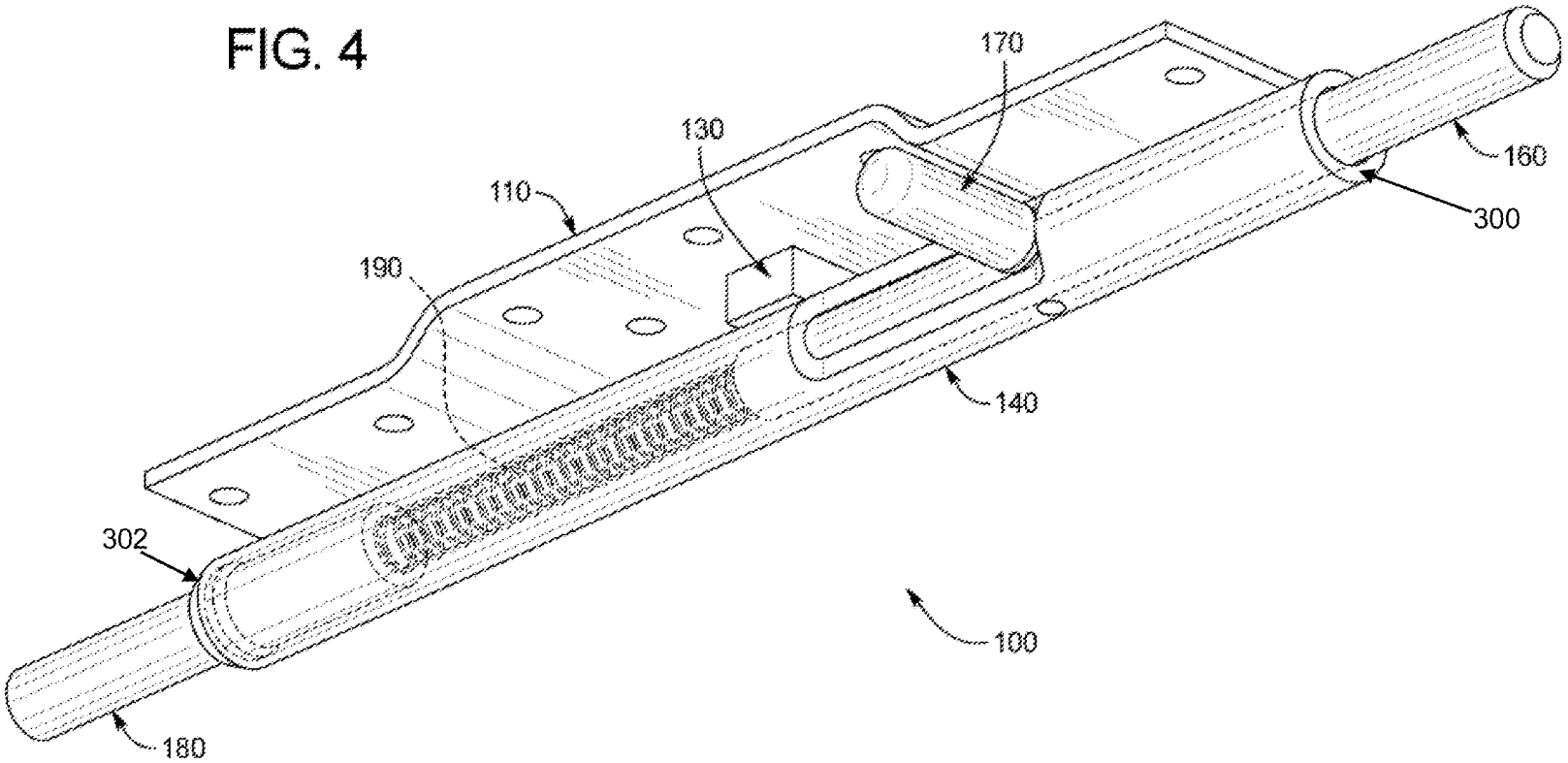
FIG. 4 is a bottom front perspective view of the locking assembly shown in FIGS. 3A and 3B with a guide channel shown in phantom lines to illustrate the components in the guide channel.
Figure 5:
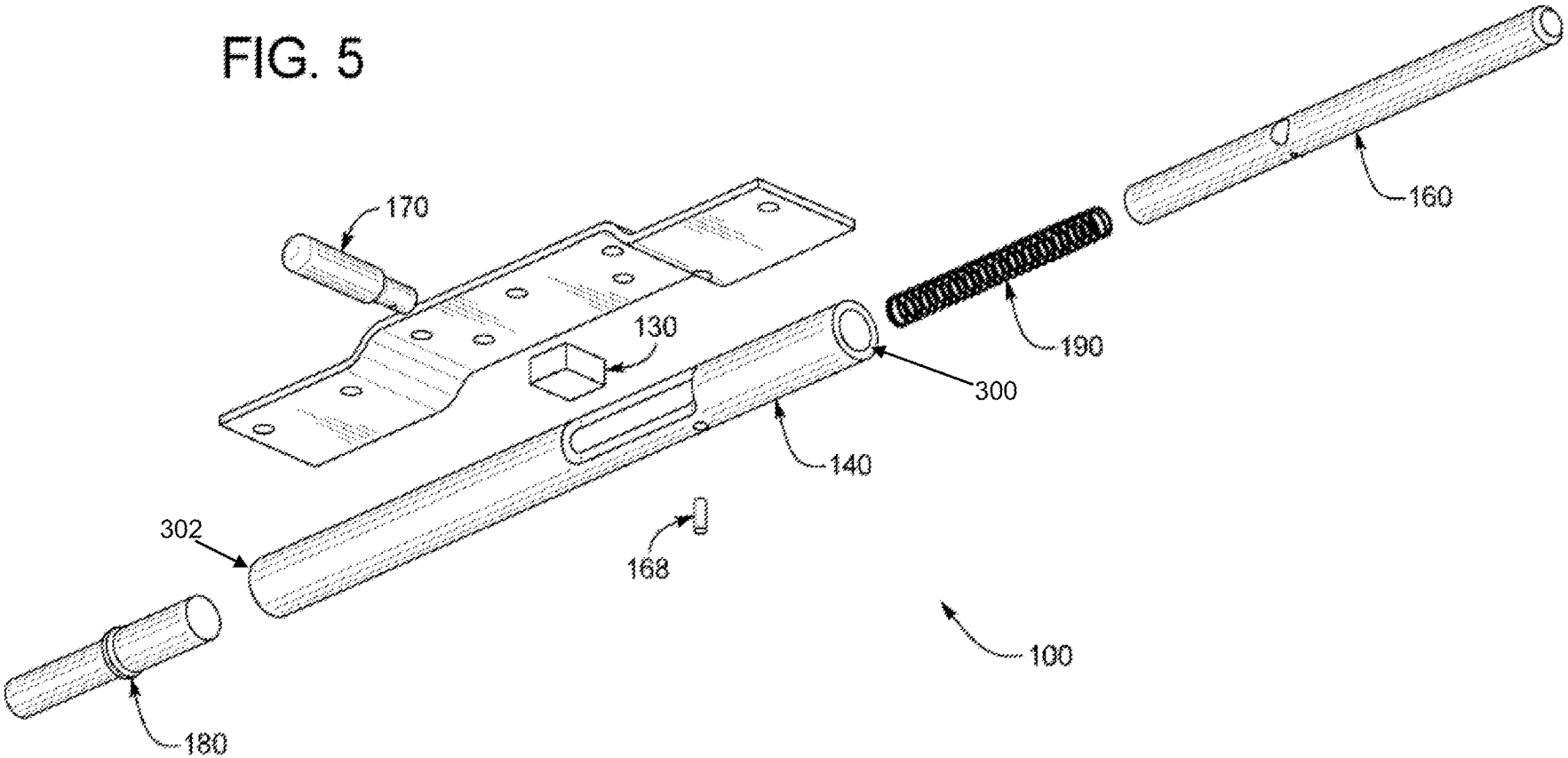
FIG. 5 is a bottom exploded perspective view of the locking assembly shown in FIGS. 3A and 3B.
Figure 6:
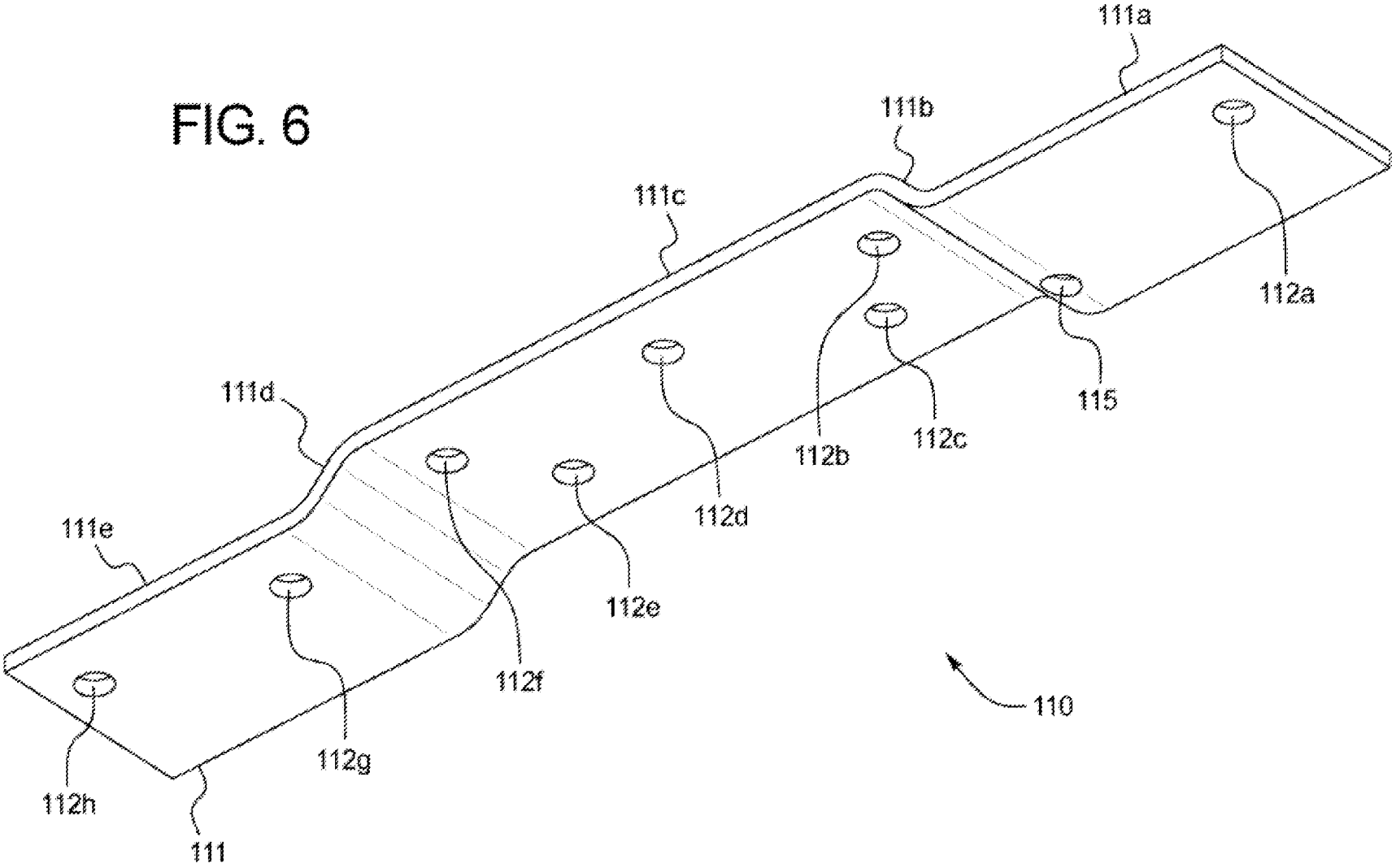
FIG. 6 is an enlarged bottom front perspective view of a support bracket of the locking assembly shown in FIGS. 3A and 3B.
Figure 7:
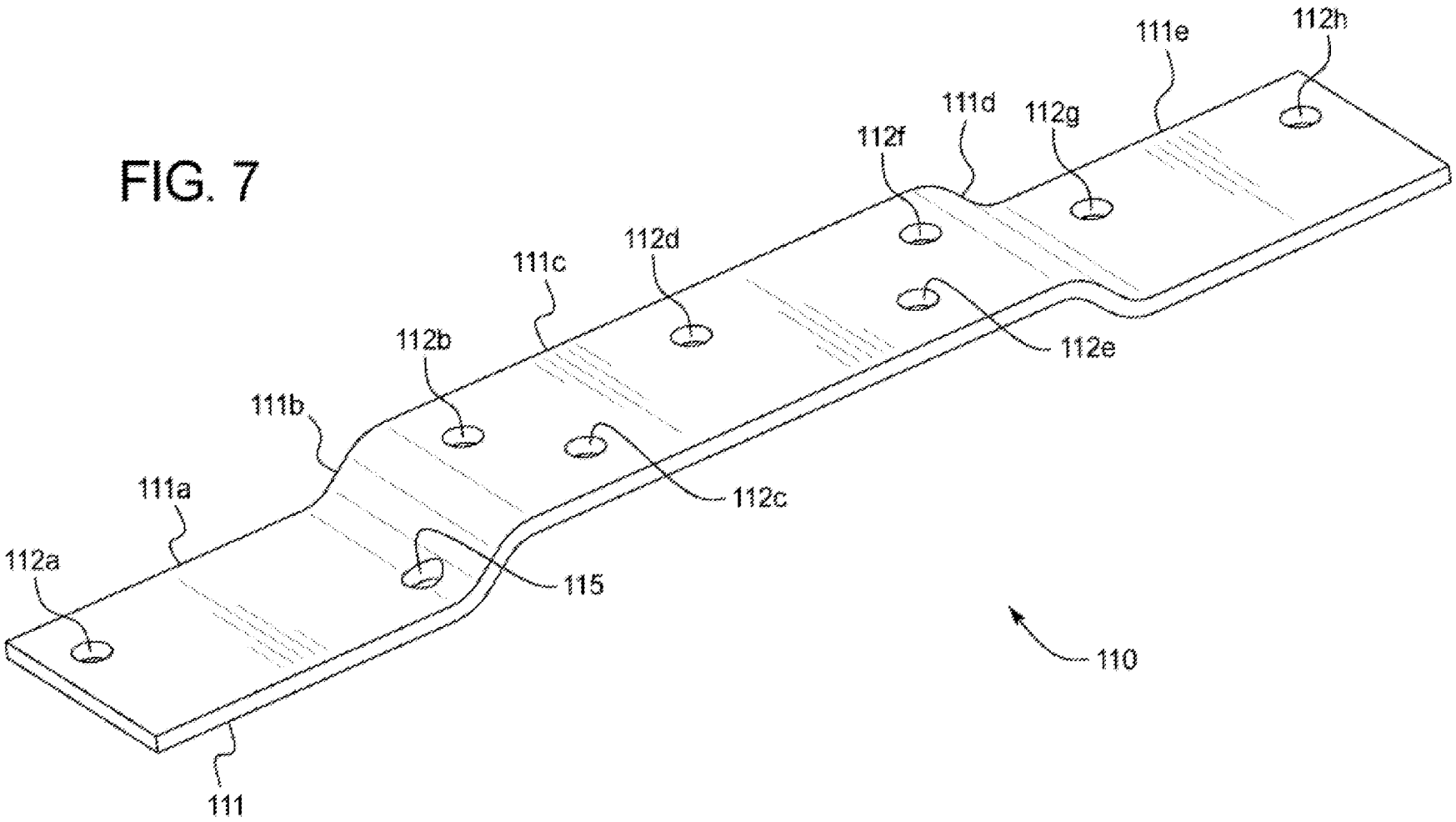
FIG. 7 is an enlarged top rear perspective view of the support bracket shown in FIG. 6.
Figure 8:
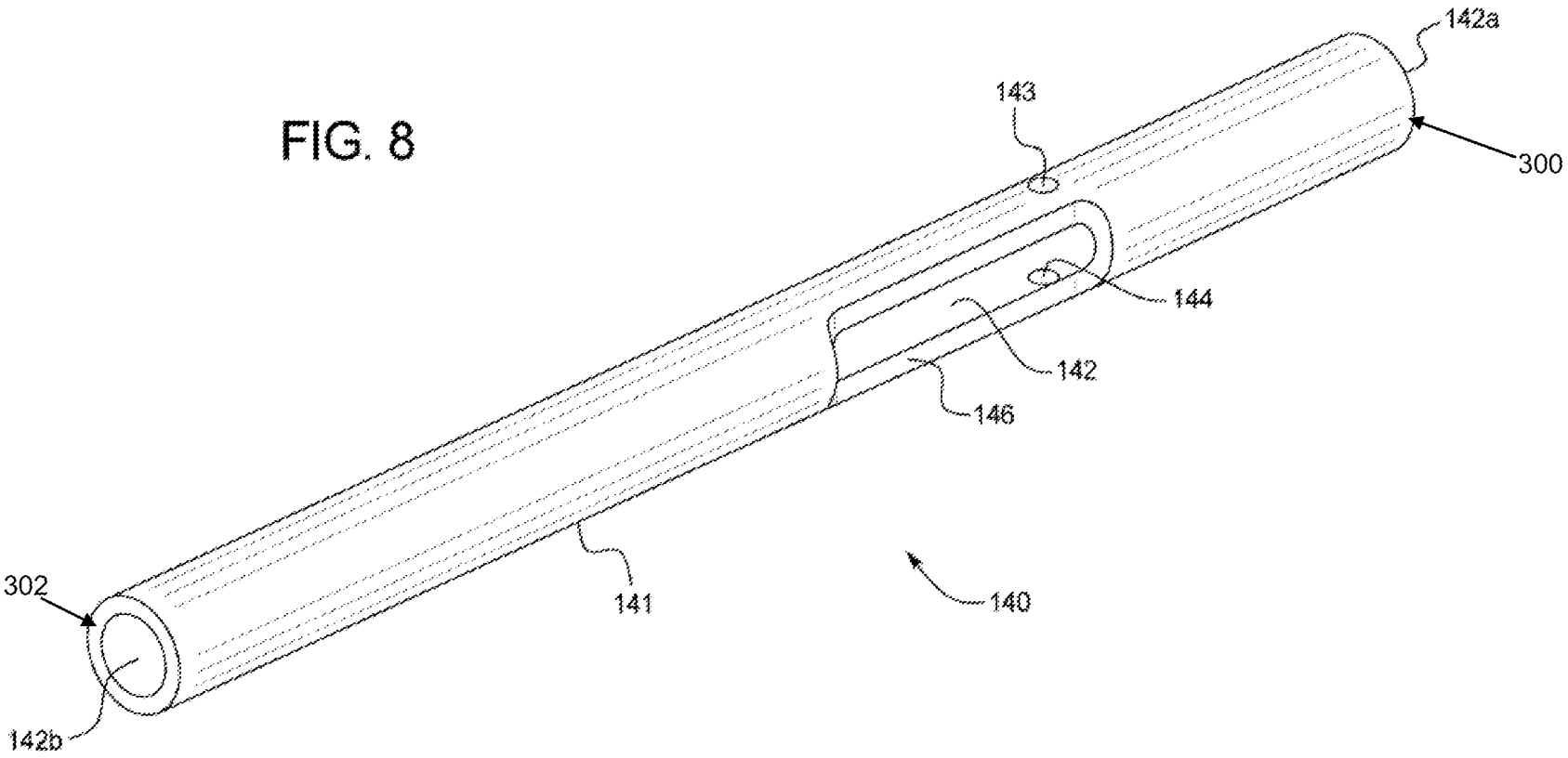
FIG. 8 is an enlarged top front perspective view of the guide channel of the locking assembly shown in FIGS. 3A and 3B.
Figure 9:
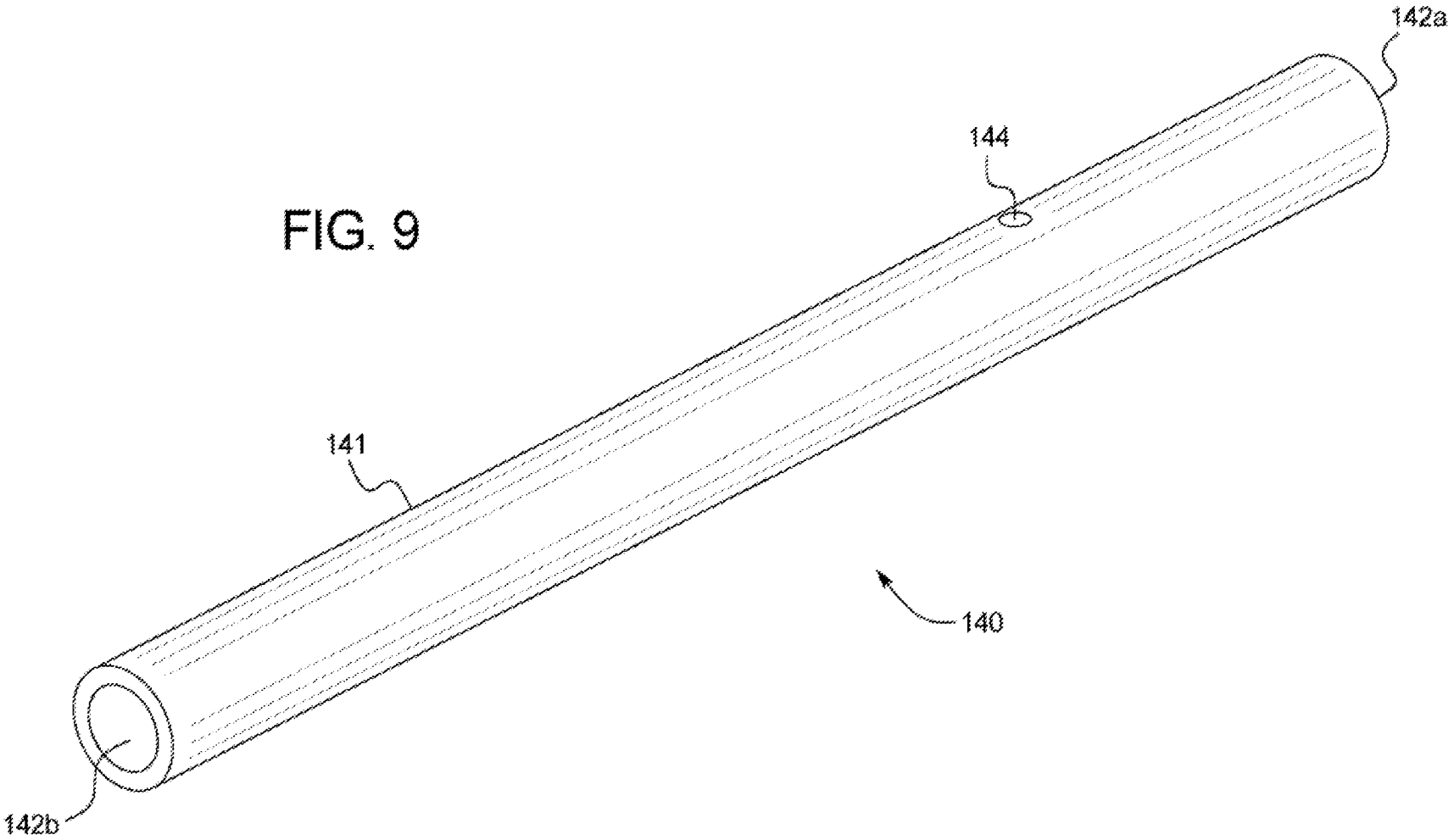
FIG. 9 is an enlarged top rear perspective view of the guide channel of the locking assembly shown in FIGS. 3A and 3B.

The locking assembly 100 includes a support bracket 110 that can be attached to the bridge plate. The locking assembly 100 also can include a support block 130 connected to the bottom of the support bracket 110. A guide tube or guide channel 140 is connected to the support bracket 110 and optionally can be connected to the support block 130. A slidable locking pin 160 is at least partially positioned in the guide channel 140. For example, the locking pin 160 can be positioned in a first end 300 of the guide channel 140 and partially extend from the first end 300 of the guide channel 140, as shown in FIG. 3A.

The locking assembly 100 includes a handle 170 that is attached to the locking pin 160. In one embodiment, the handle 170 is removable from the locking pin 160 by a removable fastener (e.g., a roll pin 168 shown in FIG. 5). Alternatively, the handle 170 may not be removeable from the pin 160 (e.g., without damaging or destroying the pin 160 and/or handle 170). The locking assembly 100 includes a pivot pin 180 partially positioned in a second end 302 of the guide channel 140. The first and second ends 300, 302 of the guide channel 140 are on opposite ends of the linear channel 140 in the illustrated embodiment. Alternatively, the guide channel 140 may not be elongated along a linear direction or axis. In the illustrated example, the pivot pin 180 extends out from the second end 302 of the guide channel 140. A resilient member 190 (shown in FIG. 4) can be positioned in the guide channel 140 between the pins 160, 180. In one example, this resilient member 190 can be a spring. The resilient member 190 can abut or otherwise engage the pivot pin 180 and the locking pin 160.

The support bracket 110, the support block 130, the guide channel 140, the slidable locking pin 160, the removable handle 170, the locking pin 160, the removable roll pin 168, the fixed pivot pin 180, and the resilient member 190 can be made from one or more metals, such as steel. Alternatively, one or more of these components of the locking assembly 100 can be made from another material. One or more of these components can be coated with a protective coating such as paint. One or more of these components can be plated.

The support bracket 110 includes an elongated body 111 formed from several sections 111*a-e*. In the illustrated embodiment, these sections of the elongated body 111 include a first section 111*a*, a second section 111*b*, a third section 111*c*, a fourth section 111*d*, and a fifth section 111*e*. The first section 111*a* and the spaced-apart fifth section 111*e* can lie in the same plane. The third section 111*c* can be located in a different plane than the sections 111*a*, 111*e*. The second section 111*b* is curved and connects the first section 111*a* to the third section 111*c*. Likewise, fourth section 111*d* is curved and connects the fifth section 111*e* to the third section 111*c*. The shapes of these sections generally correspond with the contour of the plate of the bridge plate to facilitate connection of the locking assembly 100 to the bridge plate. As a result, the shape and/or number of sections may vary from what is shown. Openings 112 *a* in the first section 111*a*, openings 112 *b*, 112 *c*, 112 *d*, 112 *e*, and 112 *f* of the third section 111*c*, and the openings 112 *g* and 112 *h* in the fifth section 111*e* are employed for attaching the locking assembly 100 to the bridge plate by suitable fasteners, such as bolts and nuts.

111*b* The support bracket 110 includes a pin removal opening 115. This opening 115 is located in the section 111*a*, but optionally may be in another section 111 of the support bracket 110. The opening 115 enables a removable fastener (e.g., the roll pin 168 shown in FIG. 5) to be removed from the locking pin 160 and the handle 170. The roll pin 168 may be removed from the locking pin 160 via the opening 115. The roll pin 168 securely holds or connects the handle 170 to the locking pin 160 but can be removed when the locking pin 160 needs to be replaced.

The support block 130 may be positioned between the third section 111*c* of the support bracket 110 and the guide channel 140. In the illustrated embodiment, the support block 130 may be connected (e.g., by welding) to the surface of the guide channel 140 that faces the support bracket 110 and also is connected (e.g., by welding) to the opposing or facing surface of the support bracket 110. Alternatively, the support block 130 may be connected to only one of the surfaces or components. The support block 130 can prevent or reduce the likelihood that the guide channel 140 will bend relative to the support bracket 110 responsive to a force imparted on the guide channel 140 toward the support bracket 110. In the illustrated embodiment, the support block is a solid cube, but optionally may have another shape. The support block can be formed from one or more metals or other materials (e.g., rubber).

The guide channel 140 can include an elongated hollow body 141. This body 141 has a cylindrical shape, but alternatively may have another shape. The body 141 defines a central cylindrical lumen 142 having end openings 142 *a* and 142 *b* at opposite ends of the body 141. The body 141 also includes roll pin openings 143, 144 on opposite surfaces of the body 141. The roll pin 168 can be inserted into or through the openings 143, 144.

The body 141 also includes an elongated handle opening 146 extending part of the length of the side of the body 141. The handle opening 146 can define a slot in which the handle 170 moves back and forth to retract and extend the locking pin 160 into and out of the body 141. For example, the handle 170 may be coupled with the locking pin 160 and protrude out of the handle opening 146 in the guide channel 140. The lumen 142 and the end opening 142*a* are configured and sized such that the locking pin 160 is freely movable within the guide tube 140. A user can slide the handle 170 within the opening 146 to the left in the perspective of FIGS. 3A, 4, and 5 to at least partially retract the locking pin 160 into the guide channel 140. The user can slide the handle 170 within the opening 146 to the right in the perspective of FIGS. 3A, 4, and 5 to at least partially protrude the locking pin 160 out of the guide channel 140.

The central lumen 142 also can be configured and sized such that the resilient member 190 can be freely movable within the guide channel 140. The central lumen 142 and the end opening 142 *b* are configured and sized such that the pivot pin 180 can be securely attached to the end of the body 141 that defines the end opening 142 *b*. The roll pin openings 143, 144 are aligned, configured, and sized such that the roll pin 168 can be inserted through either opening 143, 144 to attach the handle 170 to the locking pin 160. The roll pin 168 can be removed out of the opening 143 or 144 for detachment of the handle 170 from the locking pin 160.

The handle opening 146 is configured and sized such that part of the handle 170 extends through the opening 146 and the guide channel 140. In one embodiment, the guide channel 140 is connected (e.g., by welding) to the support bracket 110. For example, the guide channel 140 can be coupled with surfaces of the sections 111*a* and 111*e* of the support bracket 110 in multiple, spaced-apart locations. The guide channel 140 optionally can be connected to the support block 130, as described above.

Figure 10:
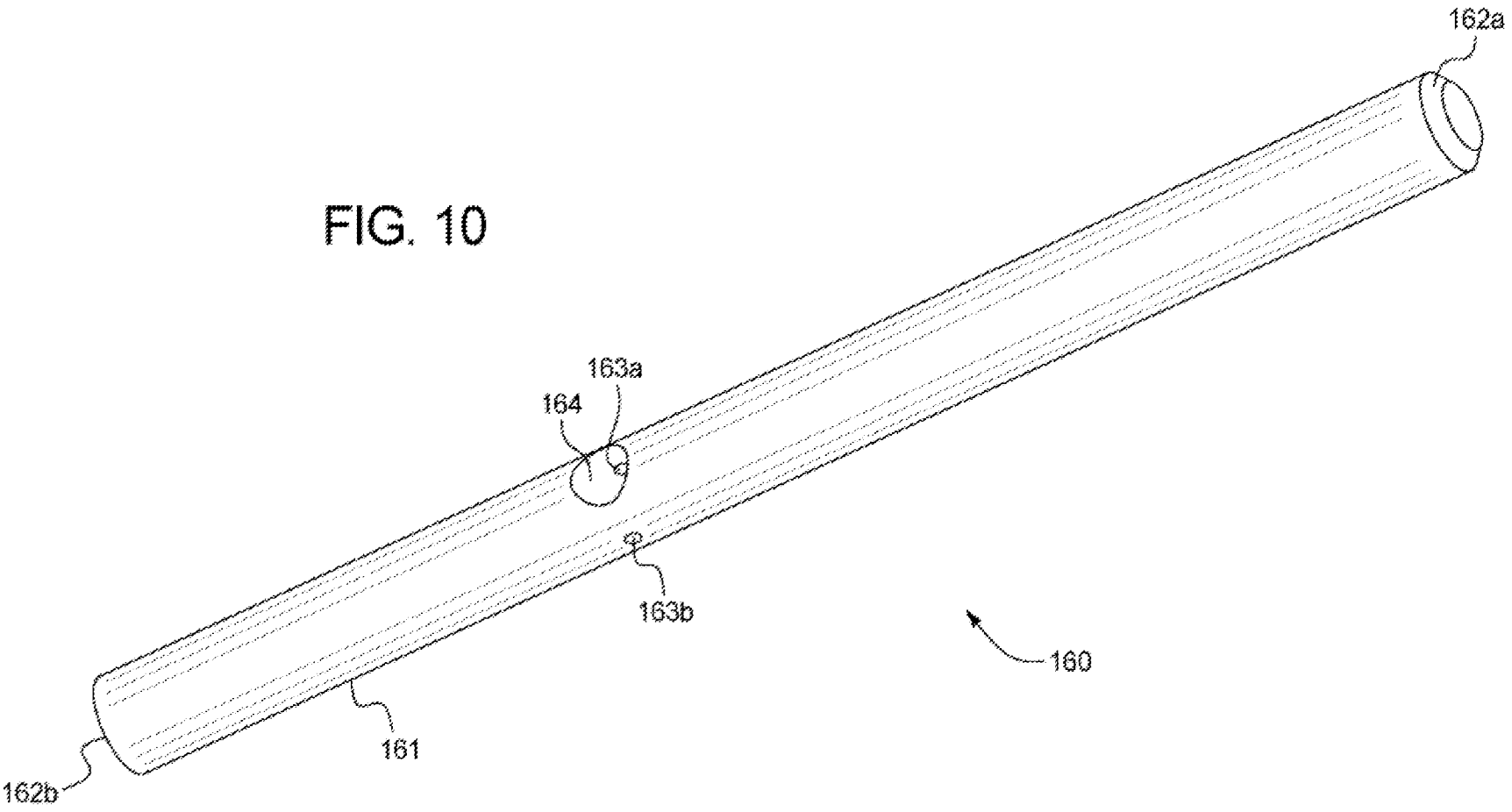
FIG. 10 is an enlarged bottom front perspective view of a locking pin of the locking assembly shown in FIGS. 3A and 3B.
Figure 11:
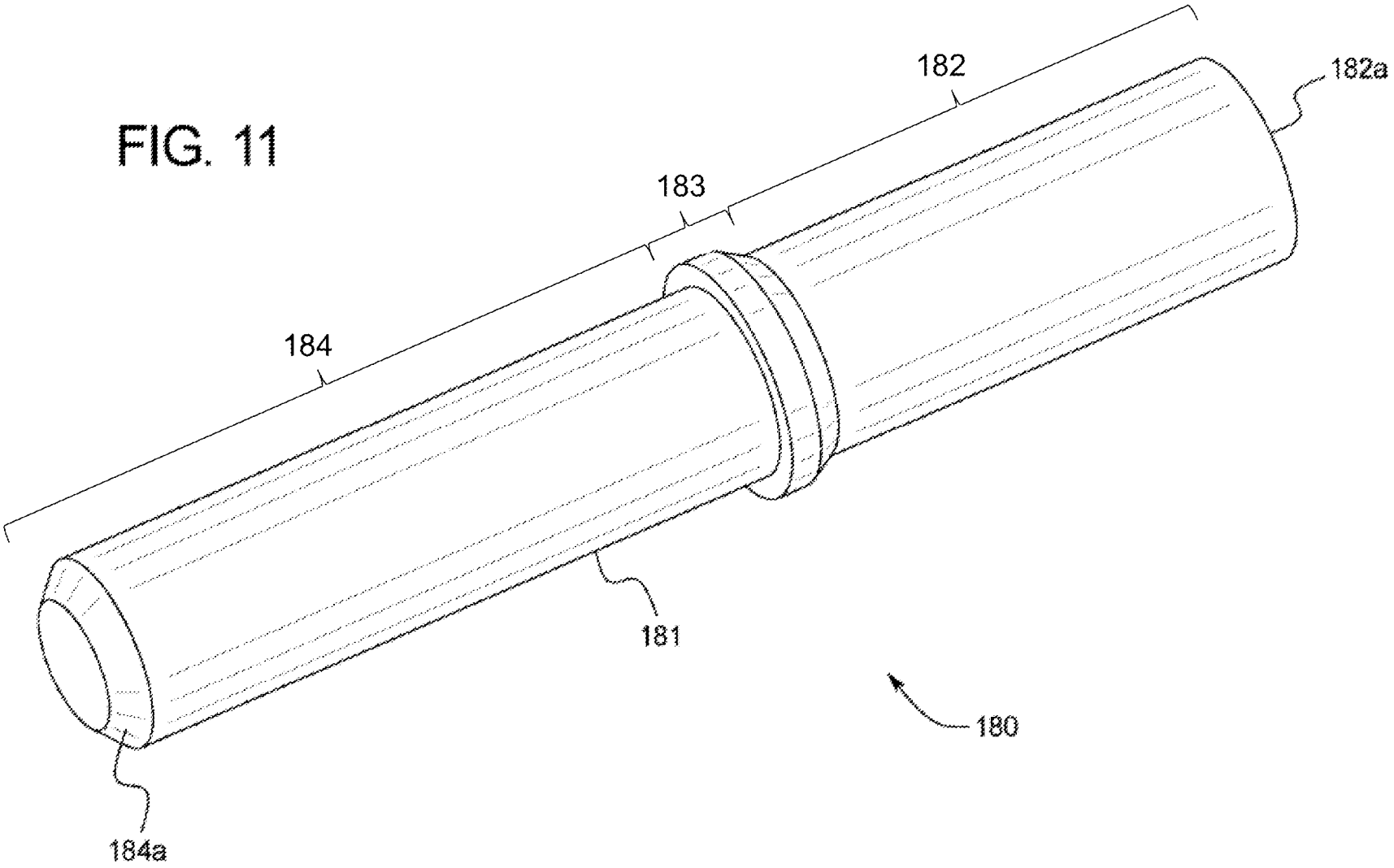
FIG. 11 is an enlarged bottom perspective view of a pivot pin of the locking assembly shown in FIGS. 3A and 3B.

The slidable locking pin 160 includes an elongated body 161 that extends from one end 162*a* to an opposite end 162*b*. The first end 162*a* can be chamfered, as shown in FIG. 10. The opposite second end 162*b* includes a flat surface for engaging the resilient member 190. The slidable locking pin 160 is configured to be partially positioned in the first end 300 of the guide channel 140 and partially extend from the first end 300 of the guide channel 140.

The locking pin 160 includes a channel extending through the locking pin 160 in directions that are transverse (e.g., orthogonal) to the directions in which the locking pin 160 is elongated. This channel defines aligned roll pin openings 163*a*, 163*b* 163*b* extending through the top and bottom portions of the body 161. The locking pin 160 includes a handle receiving opening 164 extending into the body 161. In the illustrated example, the handle receiving opening 164 extends into the body 161 in a direction that is transverse (e.g., orthogonal) to the directions along which the body 161 is elongated and the directions in which the channel that defines the openings 163*a*, 163*b* is elongated. The roll pin openings 163*a* and 163*b* are configured and sized such that the roll pin 168 can be press fit into the openings 163*a* and 163*b* to securely but removably attach the handle 170 to the locking pin 160. The handle receiving opening 164 is configured and sized such that an attachment end 172 of the handle 170 (shown in FIG. 12) can be inserted into the opening 164 of the locking pin 160.

In one embodiment, the end 162*a* of the elongated body 161 of the locking pin 160 can be inserted in a locking pin receiver in another component, such as an auto-rack car. This can lock or secure the locking assembly 100 to which the locking assembly 100 is coupled, such as the bridge plate 202, to the receiver.

Figure 12:
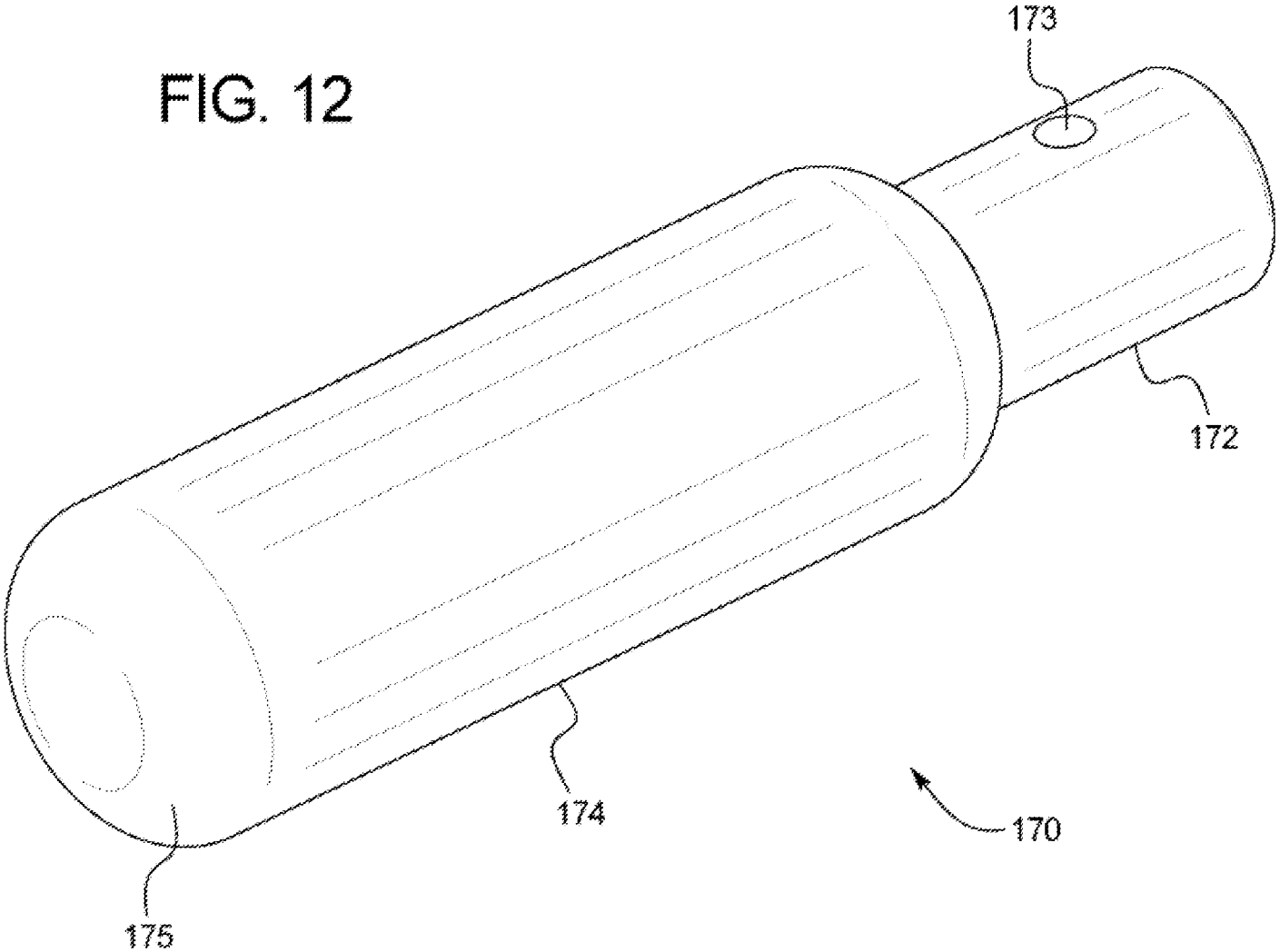
FIG. 12 is an enlarged top perspective view of a handle of the locking assembly shown in FIGS. 3A and 3B.

The handle 170 includes an elongated body having an attachment section 172 and a gripping section 174, as shown in FIG. 12. The attachment section 172 of the handle 170 includes a roll pin channel 173 extending through the entire body 171. The roll pin channel 173 is configured and sized such that the roll pin 168 can be at least partially inserted into the channel 173 to attach the handle 170 to the locking pin 160. For example, the roll pin 168 can be inserted through the opening 163*a* or the opening 163*b* in the locking pin 160 when the attachment end 172 of the handle 170 is inserted into the opening 164 in the locking pin 160. The roll pin 168 is inserted through the opening 163*a* or the opening 163*b* in the locking pin 160 to be inserted into the channel 174 of the handle 170 to secure the handle 170 to the pin 160. In the illustrated embodiment, the gripping section 174 of the handle 170 includes a rounded end 175.

The pivot pin 180 includes an elongated body 181 having several sections including a first end section 182, an intermediate or middle section 183, and a second end section 184. The end sections 182, 184 are located on opposite ends of the pivot pin 180. The pivot pin 180 is configured to be partially positioned in the second end 142 of the guide channel 140 and to partially extend (e.g., protrude) from the second end 142 of the guide channel 140. The first section 182 can be inserted into the second end 142 of the guide tube 140 through the opening 142*b*.

The first end section 182 of the pivot pin 180 defines a flat engagement end 182*a*. This end 182*a* can engage the resilient member 190 inside the guide tube 140. The second end section 184 of the pivot pin 180 can have a chamfered end 184*a* that extends from the end of the guide tube 140 and is shaped to be removably inserted in a pivot pin receiver. Alternatively, the second end section 184 has another shape.

The intermediate section 183 of the pivot pin 180 can have a greater circumference than the end sections 182, 184. The intermediate section 183 can be larger than the opening 142*b* at the end 302 of the guide tube 140. This can limit how far the pivot pin 180 can be inserted into the guide tube 140. In one embodiment, the intermediate section 183 can be welded or otherwise affixed to the end 302 of the guide tube 140. The intermediate section 183 of the pivot pin 180 may have a central cylindrical surface, a tapered outer surface, and a transverse flat inner surface. In the illustrated embodiment, the pivot pin 180 can be machined to specific tolerances to securely fit in the guide tube 140 and the pivot pin receiver on an auto-rack car. The pivot pin may be generally solid and include cylindrical sections. Alternatively, the pivot pin may be hollow and/or have another shape. The pivot pin 180 can be welded to the guide tube 140, but could be otherwise secured such that the pivot pin 180 does not move relative to the guide tube 140.

The resilient member 190 can be a coil spring configured and sized to be positioned in the guide tube 40 between the pivot pin 180 and the locking pin 160. The resilient member 190 has a first end configured to engage or butt up against the end 162*b* of the locking pin 160. An opposite second end of the resilient member engages or butts up against the end 182*a* of the first section 182 of the pivot pin 180. The resilient member 190 can apply a biasing force against the locking pin 160. This force can push the locking pin 160 toward or partially outward from the end 300 of the guide tube 140. In the illustrated embodiment, the resilient member 190 is cylindrical but alternatively may have another shape.

The pivot pin 180 can be inserted in a first receiver and the handle 170 can be slid to move the locking pin 160 into the guide tube 140. The locking pin 160 can then be aligned with a second receiver and the handle 170 can be moved away from the pivot pin 180 to slide the locking pin 160 away from the guide tube 140 and into the second receiver. This can secure the locking assembly 100 to the first and second receivers (or the component(s) that include the first and second receivers). These receivers can be recesses, tubes, or the like.

If the locking pin 160 is bent, damaged in use, or otherwise needs to be replaced, the locking pin 160 can be removed by removing (e.g., pushing) the roll pin 168 out from the roll pin openings 163*a* and 163*b* and the roll pin opening 173 through the opening 143 in the guide tube 140 and through the pin removal opening 115 in the support bracket 110. Alternatively, in this illustrated embodiment, the roll pin 168 can be pushed out from the roll pin openings 163*a* and 163*b* and the roll pin opening 173 through the opening 144 in the guide tube 140. A tool such as punch can be inserted in the respective openings to engage and push out the roll pin 168. The pin removal opening 115 in the support bracket 110 facilitates the insertion of such a tool and the removal of the roll pin 168.

After the roll pin 168 is removed, the handle 170 can then be removed from the locking pin 160. The locking pin 160 can then be removed from the guide tube 140. A replacement locking pin 160 can then be inserted into the guide tube 140 such that the pin removal opening 115, the roll pin opening 143, the roll pin opening 144, and the roll pin openings 163*a* and 163*b* are aligned with each other. The attachment section 172 of the handle 170 can be inserted into the handle receiving opening 164 of the locking pin 160 such that the roll pin opening 173 is aligned with the pin removal opening 115, the roll pin opening 143, the roll pin opening 144, and the roll pin openings 163*a* and 163*b*. The roll pin 168 can be inserted through the opening 143 and press fit into roll pin opening 163*a* and roll pin opening 173 of the handle 170. This secures the handle 170 to the replacement locking pin 160. The handle 170 and the roll pin 168 also can be replaced in this manner.

The removable handle 170 and the locking pin 160 enable the locking pin 160 to be replaced if the locking pin 160 is bent or otherwise damaged during use, installation, or removal. The combination of these components enables the locking assembly 100 to be readily and efficiently repaired without the need to replace the entire locking assembly 100 or entire bridge plate.

With respect to auto-rack railroad car bridge plates, the locking assembly 100 can eliminate or reduce the need for a collar described above.

The pivot pin of the locking assembly 100 can be securely attached to the guide tube 140, which can eliminate loosely attached pivot pins.

Figure 13:
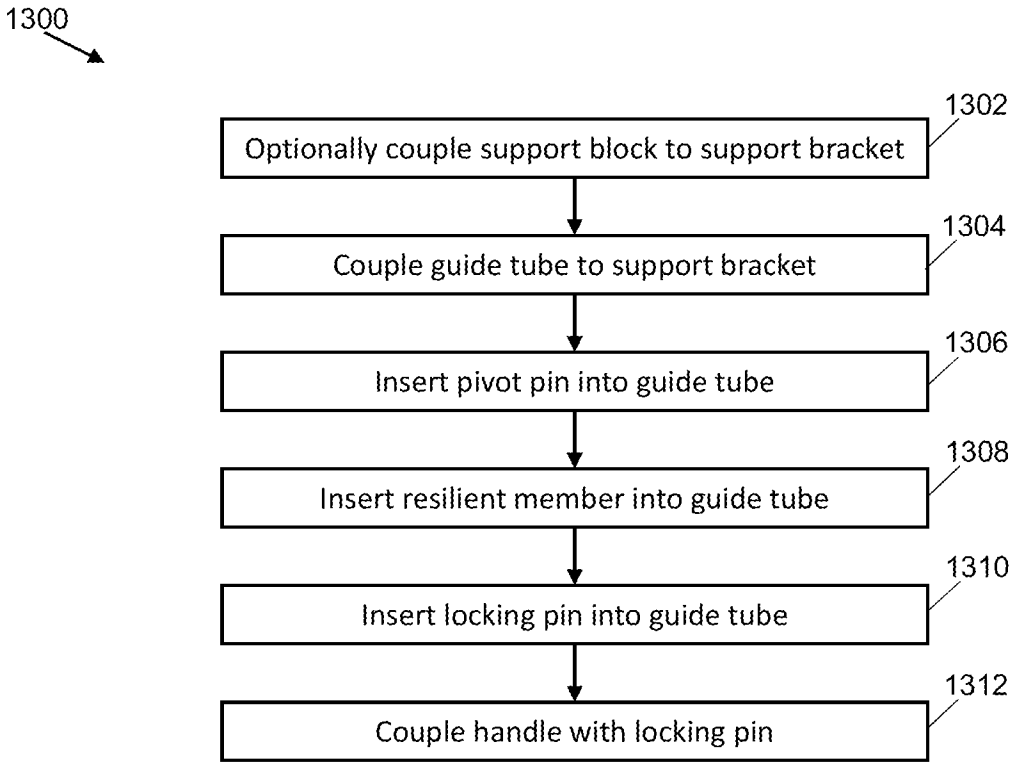
FIG. 13 illustrates a flowchart of one embodiment of a method for creating a locking assembly.

FIG. 13 illustrates a flowchart of one embodiment of a method 1300 for creating a locking assembly. The method 1300 can represent the operations performed to form one or more embodiments of the locking assembly 100 described herein. The operations of the method 1300 may be performed in a different order or sequence than what is shown in FIG. 13. At 1302, the support block 130 optionally is coupled to the support bracket 110. Optionally, the support block 130 may not be coupled to the support bracket 110. At 1304, the guide tube 140 is coupled to the support bracket 110. The guide tube 140 can be fastened to the support bracket 110 in multiple locations, such as the first section 111*a* and the fifth section 111*c* of the support bracket 110, and to the support block 130.

At 1306, the pivot pin 180 is inserted into the guide tube 140. The first section 182 of the pivot pin 180 can be inserted into the end 302 of the guide tube 140. The intermediate section 183 of the pivot pin 180 optionally can be affixed to the end 302 of the guide tube 140. At 1308, the resilient member 190 is inserted into the guide tube 140. In one embodiment, the spring resilient member 190 can be inserted into the guide tube 140 through the opposite end 300 of the guide tube 140.

At 1310, the locking pin 160 is inserted into the guide tube 140. The locking pin 160 can be inserted into the guide tube 140 through the end 300 that is opposite of the pivot pin 180. The locking pin 160 can be inserted into the guide tube 140 such that the pin removal opening 115 and the roll pin openings 143, 144, 163*a*, 163*b* are aligned with each other. For example, these openings 115, 143, 144, 163*a*, 163*b* can be aligned with each other when the openings are coaxial with each other or are otherwise have centers located on the same linear axis.

At 1312, the handle 170 is coupled with the locking pin 160. For example, the attachment section 172 of the handle 170 can be inserted through the handle opening 146 in the guide tube 140 and into the handle receiving opening 164 of the locking pin 160. The handle 170 can be inserted such that the roll pin opening 173 defined by the handle 170 also is aligned with the openings 115, 143, 144, 163*a*, 163*b*. Optionally, the roll pin 168 can be inserted through the opening 143 and fit into the roll pin openings 163*a* and 163*b* and the roll pin opening 173 defined by the handle 170. This can secure the handle 170 to the locking pin 160.

In one embodiment, a locking assembly is provided that includes an elongated guide tube configured to be coupled to a first component. The guide tube is elongated in a first direction from a first end to an opposite second end. The locking assembly also includes a first pin partially disposed in the guide tube and protruding from the first end of the guide tube. The first pin can be received in a first receiver. The locking assembly also includes a second pin partially disposed in the guide tube and protruding from the second end of the guide tube. This second pin can be received in a second receiver. The locking assembly also includes a handle removably coupled with the second pin. The handle can be grasped and moved to slide the second pin relative to the guide tube and the first pin along the first direction.

Optionally, the locking assembly also includes a roll pin removably coupled with the handle. The roll pin can be inserted into the handle to secure the handle to the second pin and to be removed from the handle to detach the handle from the second pin.

The guide tube may include an opening and the handle may include a channel aligned with each other along a second direction. The opening in the guide tube and the channel in the handle can be aligned with each other to receive the roll pin along the second direction. The first direction in which the guide tube is elongated and the second direction in which the opening in the guide tube and the channel in the handle are aligned can be orthogonal to each other.

The locking assembly can include a resilient member disposed within the guide tube between the first pin and the second pin. This resilient member can impart a force on the second pin in the first direction.

The guide tube can include an elongated slot located between the first end and the second end of the guide tube. The handle can protrude from the second pin out of the slot.

The first and second receivers may be disposed in a second component. The second pin can be moved outward from the guide channel along the first direction to be received in the second receiver and couple the first component with the second component.

Another locking assembly includes a guide channel configured to be coupled to a first component and extending from a first open end to a second open end, a pivot pin partially disposed in the guide channel at the first open end, a locking pin partially disposed in the guide channel at the second open end, and a handle removably coupled with the locking pin. The handle is configured to be moved relative to the guide channel to slide the locking pin out of or into the guide channel.

The locking assembly optionally can include a roll pin removably coupled with the handle. The roll pin can be inserted into the handle to secure the handle to the locking pin and to be removed from the handle to detach the handle from the locking pin. The guide channel may include an opening and the handle includes a channel aligned with each other to receive the roll pin.

The locking assembly optionally includes a resilient member disposed within the guide channel between the pivot pin and the locking pin. This resilient member can impart a force on the locking pin toward the second open end of the guide channel.

The guide channel may include an elongated slot located between the first open end and the second open end of the guide channel. The handle protrudes from the locking pin out of the slot.

The guide channel can be configured to be mounted to a first component, the pivot pin received into a second component, and the locking pin received into the second component to secure the first component to the second component.

Another example of a locking assembly includes a guide tube configured to be coupled to a first component. The guide tube extends in a first direction from a first open end to a second open end. The locking assembly also includes a first pin protruding from the first open end of the guide tube. The first pin is configured to be received in a second component. The locking assembly includes a second pin protruding from the second open end of the guide tube. The second pin is configured to move relative to the guide tube and the first pin to be received in the second component. The locking assembly also includes a handle removably coupled with the second pin. The handle is configured to be grasped and moved to slide the second pin relative to the guide tube and the first pin.

The locking assembly also can include a roll pin removably coupled with the handle and configured to be inserted into the handle to secure the handle to the second pin and to be removed from the handle to detach the handle from the second pin.

The guide tube may include an opening and the handle may include a channel aligned with each other. The opening in the guide tube and the channel in the handle can be aligned with each other to receive the roll pin along the second direction.

The locking assembly optionally includes a resilient member disposed within the guide tube between the first pin and the second pin. The guide tube can include an elongated slot located between the first open end and the second open end of the guide tube, where the handle protrudes from the second pin out of the slot.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A locking assembly comprising:

an elongated guide tube configured to be coupled to a first component, the guide tube elongated in a first direction from a first end to an opposite second end;

a first pin partially disposed in the guide tube and protruding from the first end of the guide tube, the first pin configured to be received in a first receiver;

a second pin partially disposed in the guide tube and protruding from the second end of the guide tube, the second pin configured to be received in a second receiver;

a handle coupled with the second pin, the handle configured to be grasped and moved to slide the second pin relative to the guide tube and the first pin along the first direction; and a resilient member disposed within the guide tube between the first pin and the second pin, the resilient member imparting a force on the second pin in the first direction.

2. The locking assembly of claim 1, further comprising a roll pin removably coupled with the handle, the roll pin configured to be inserted into the handle to secure the handle to the second pin and to be removed from the handle to detach the handle from the second pin.

3. The locking assembly of claim 2, wherein the guide tube includes an opening and the handle includes a channel aligned with each other along a second direction, the opening in the guide tube and the channel in the handle aligned with each other to receive the roll pin along the second direction.

4. The locking assembly of claim 3, wherein the first direction in which the guide tube is elongated and the second direction in which the opening in the guide tube and the channel in the handle are aligned are orthogonal to each other.

5. The locking assembly of claim 1, wherein the guide tube includes an elongated slot located between the first end and the second end of the guide tube, the handle protruding from the second pin out of the slot.

6. The locking assembly of claim 1, wherein the first and second receivers are disposed in a second component, the second pin moved outward from the guide channel along the first direction to be received in the second receiver and couple the first component with the second component.

7. A locking assembly for a bridge plate, the locking assembly comprising:

a guide channel configured to be coupled to a first component, the guide channel extending from a first open end to a second open end;

a pivot pin partially disposed in the guide channel at the first open end;

a locking pin partially disposed in the guide channel at the second open end; and a handle coupled with the locking pin, the handle configured to be moved relative to the guide channel to slide the locking pin out of or into the guide channel.

8. The locking assembly of claim 7, further comprising a roll pin removably coupled with the handle, the roll pin configured to be inserted into the handle to secure the handle to the locking pin and to be removed from the handle to detach the handle from the locking pin.

9. The locking assembly of claim 8, wherein the guide channel includes an opening and the handle includes a channel aligned with each other to receive the roll pin.

10. The locking assembly of claim 7, further comprising a resilient member disposed within the guide channel between the pivot pin and the locking pin.

11. The locking assembly of claim 10, wherein the resilient member imparts a force on the locking pin toward the second open end of the guide channel.

12. The locking assembly of claim 7, wherein the guide channel includes an elongated slot located between the first open end and the second open end of the guide channel, the handle protruding from the locking pin out of the slot.

13. The locking assembly of claim 7, wherein the guide channel is configured to be mounted to a first component, the pivot pin is configured to be received into a second component, and the locking pin is configured to be received into the second component to secure the first component to the second component.

14. An auto-rack railroad car bridge plate locking assembly comprising:

a support bracket configured to be attached to a bridge plate for an auto-rack railroad car;

an elongated guide tube coupled to the support bracket, the guide tube elongated in a first direction from a first end to an opposite second open end;

a first pin partially disposed in the guide tube and protruding from the first end of the guide tube, wherein the first pin is fixed relative to the guide tube, and wherein the first pin is configured to be received in a first receiver attached to the auto-rack railroad car;

a second pin partially disposed in the guide tube and protruding from the second open end of the guide tube, the second pin configured to be received in a second receiver attached to the auto-rack railroad car;

a handle coupled with the second pin, the handle configured to be grasped and moved to slide the second pin relative to the guide tube and the first pin; and a spring disposed within the guide tube between the first pin and the second pin and configured to impart a force on the second pin in the first direction;

wherein the guide tube includes an elongated slot located between the first end and the second end of the guide tube, the handle protruding from the second pin out of the slot;

wherein the second pin is configured to be retracted into the guide channel by pulling the handle in a second direction, opposite the first direction and towards the first pin, against the force imparted by the spring, and wherein the second pin is configured, when the second pin is aligned with the second receiver and the handle is released, for the spring to push the second pin in the first direction for the second pin to be received in the second receiver and couple the bridge plate with the auto-rack railroad car; and wherein the support bracket comprises an elongated body having first and second sections that are spaced apart from one another and lie in a same plane, the elongated body also having a third section lying between the first and second sections and located in a different plane than the same plane of the first and second sections, and the first and second sections being connected to respective opposite side edges of the third section by respective curved transition sections, the elongated guide tube being coupled at least to the first and second sections of the elongated body of the support bracket.

15. The assembly of claim 14, further comprising a roll pin removably coupled with the handle, the roll pin configured to be inserted into the handle to secure the handle to the second pin and to be removed from the handle to detach the handle from the second pin.

16. The assembly of claim 15, wherein the guide tube includes an opening and the handle includes a channel aligned with each other along a third direction, the opening in the guide tube and the channel in the handle aligned with each other to receive the roll pin along the third direction.

17. The assembly of claim 16, wherein the first direction in which the guide tube is elongated and the third direction in which the opening in the guide tube and the channel in the handle are aligned are orthogonal to each other.

18. A bridge plate assembly for an auto-rack railroad car, comprising:

the auto-rack railroad car bridge plate locking assembly of claim 14; and a bridge plate, wherein the support bracket of the locking assembly is attached to the bridge plate.

* * * * *